United States Patent [19]

Castiglioni

[11] Patent Number: 4,897,017

[45] Date of Patent: Jan. 30, 1990

[54] VERTICAL SIGNATURE STACKER

[75] Inventor: Antonio Castiglioni, Varallo Pombia, Italy

[73] Assignee: Civiemme S.r.l., Bogogno, Italy

[21] Appl. No.: 44,441

[22] Filed: Apr. 30, 1987

[30] Foreign Application Priority Data

May 2, 1986 [IT] Italy ..... 20299 A/86

[51] Int. Cl.[4] ..... B65G 57/02

[52] U.S. Cl. ..... 414/790.8; 271/218; 414/790

[58] Field of Search ..... 271/218; 414/43, 45, 414/48, 50, 790, 790.8, 794.4

[56] References Cited

U.S. PATENT DOCUMENTS 3,279,792 10/1966 Kostal et al. ..... 271/218
3,969,993 7/1976 Stobb ..... 271/218 X
4,311,090 1/1982 Dudziak et al. ..... 414/43 X
4,367,997 1/1983 Schweingruber ..... 414/46 X
4,538,511 9/1985 Wise ..... 414/43 X

*Primary Examiner*—Robert J. Spar
*Assistant Examiner*—Janice Krizek
*Attorney, Agent, or Firm*—Woodcock Washburn Kurtz Mackiewicz & Norris

[57] ABSTRACT

A vertical signature stacker comprises a separator plate supported within a stacker framework for removal of signatures from a conveyor belt and delivery thereof to a fork. The separator plate is supported by a slide frame that may be tilted and vertically adjusted. The separator plate is also adjustable in a horizontal direction. The fork receives signature stacks and is vertically adjustable. The separator plate has an upper limit stop that is generally level with the head of an operator.

10 Claims, 2 Drawing Sheets

VERTICAL SIGNATURE STACKER

BACKGROUND OF THE INVENTION

This invention relates to an improved vertical signature stacker. This type of stacker is already widely known, as evidenced, for example, by U.S. Pat. No. 3,969,993. Essentially, these vertical stackers comprise a stacker framework, conveyor belts for supporting the signatures delivered by a rotary press, an outer separator plate designed to interrupt the continuous flow of incoming signatures and form the initial part of the stack, translation guides and powered units designed to raise and lower the separator plate, a fork onto which the stacks delivered by the separator plate are placed, said fork being supplied with translation guides and with powered units governing the upward and downward motion of same, a sliding wall for lowering the stacks and a bottom wall for supporting the stacks so formed, said sliding and bottom walls being provided in the form of roller boards.

The separator plate, with the relevant jack controlling the forward and reverse motion of same, is hinged onto an outer support located in the upper front section of the stackers and, more specifically, in such a way that when the plate reaches its bottom limit stop position, it is roughly equal in height to the stacker operator. This design entails a number of shortcomings and disadvantages, the most serious of which shall be referred to hereinafter. At the end of its downstroke, the separator plate reaches a height where it is roughly level with the head of the operator; after reaching this position, the plate is tilted upwards, and the upstroke is effected. Besides causing considerable inconvenience, these movements may prove a serious hazard to the operator's safety. In addition, as the separator plate runs along a plane which cuts across the middle of the stacker, the operator tends to stand either to the right or to the left of the stacker, which makes it somewhat more difficult to follow closely all the steps involved in the stacking process. Since the strokes of the separator plates normally measure approximately 40 cms and the height of the plate in its lowermost position ranges from 180 to 190 cms, it readily follows that the overall height of the stackers adds up to roughly 220–230 cms. This design, therefore, implies significant additional construction costs and, furthermore, fails to take into account some basic operative requirements, in that the operator must virtually "climb" up the stacker in order to gain access to the upper section thereof and to adjust and line up the upper stacking positioners. Moreover, the higher the construction, the greater the length of the signature conveyor belts required for its operation; this, in turn, means that more powerful equipment must be used in order to drive said belts and that expensive, tailor-made guide pulleys must be employed. A further disadvantage inherent in these exceedingly high stackers is that the relevant conveyor belt paths feature a steeply sloping section, which often results in undesired slippage or overlapping of signatures, e.g. where coated paper is used.

Conventional vertical stackers present other shortcomings, in that both the separator plate and the fork are operated by a single electric motor featuring a dual friction clutch as regards the downstrokes of the plate and fork, whereas the upstrokes of same are effected by means of pneumatic cylinder-ram units. The fork-driving pneumatic cylinder-ram unit also acts as a braking device when the stack is lowered at considerable speed after its completion. In addition to the fact that these pneumatic units entail substantial costs, it is worth noting that said pneumatic braking devices are rather difficult to calibrate, for the stacks, while lowered from one and the same height, may vary in weight depending on the degree of compactness of the relevant signatures. These pneumatic units are furthermore ineffective in interrupting or reducing the speed of the downstroke of the fork, while this would be desirable in the extreme in order to ensure proper automatic loading of the endboards which are normally placed at the upper ends of the stacks.

While conventional vertical stackers feature a steeply sloping conveyance section, they may sometimes require a relatively long conveyance path in order to avoid the exceedingly steep slopes which may result from direct connection to the rotary press, as these would pose additional difficulties in terms of an even conveyance of the scaled stream of signatures. This necessarily implies a considerable overall width, while printing shops are normally rather small in size and therefore require a most efficient use of the space available. The adoption of bulky equipment, such as the stackers described hereinabove, may sometimes require additional work in order to accommodate the equipment itself in the existing facilities.

SUMMARY OF THE INVENTION

The main object of this invention is to provide an improved vertical signature stacker, designed in such a way as to avoid the drawback inherent in conventional stackers—wherein the downstroke limit stop of the separator plate is roughly level with the head of the operator—while featuring reduced overall dimensions and offering an effective solution to the structural and functional shortcomings referred to earlier.

A further object of this invention is to provide a vertical stacker offering the possibility to interrupt temporarily the quick downstroke of the fork so that the upper endboards may be placed onto the stacks automatically.

Yet another object of this invention is to provide a stacker constructed in such a way as to enable the operator to readily gain access to each and every part or section thereof, in order to simplify and speed up the adjustment of the positioning devices located in the upper part of the stacker and, therefore, enable the operator to perform these functions without undue effort or inconvenience and furthermore check the stacker for correct operation while retaining a central, i.e. symmetrical, position with respect to the stacker itself. In the device according to the invention, in fact, the upper limit stop of the separator plate is roughly level with the head of the operator, hence the latter is in the position to take any remedial action which may be required in the initial stage of stacking. Yet another object of the improved stacker according to this invention is to provide a substantially horizontal signature-conveying path taking up an extremely limited amount of space. This design ensures greater effectiveness and a more uniform conveyance of the signatures.

These objects are achieved according to the invention with a vertical signature stacker comprising:

a stacker framework 2;

a belt-driven conveyance path for the signatures delivered by a rotary press;

a separator plate 17 designed to interrupt the flow of signatures and form the initial part of each stack 16;

translation guides 26 and driving units 26c designed to raise and lower the separator plate 17;

a fork 8 onto which the bundles 16 delivered by the separator plate are placed, said fork being equipped with translation guides 7, 7a, 7b and with driving units designed to raise and lower same;

a sliding wall 14 for lowering the stacks 16 and a stack-supporting wall 15, both of which are made up of a number of rollers;

wherein the separator plate 17 is designed to rest on a sliding frame 19 within the framework 2 of the stacker, said sliding frame being supported by a powered cursor 18 through a floating connection whereby the frame may be tilted up and down, said frame 19 being furthermore connected to translation guides 26 designed to control the upstrokes and downstrokes of the separator plate, the upper limit stop position of the latter being roughly level with the head of the operator, wherein furthermore the abovementioned units 26c, 9 designed to drive respectively the separator plate 17 and the fork 8 are preferably independent and conceived as reversing electric motors.

According to the invention, the sliding frame 19 of the separator plate 17 comprises two slide bars 21 featuring a cursor 18 in the form of two sleeves 22 connected to each other by a plate-supporting cross member 23, and said frame 19 is furthermore connected to a cylinder-ram unit 24 driving the plate 17 back and forth, the piston rod of said unit 24 being connected to said cursor 18.

A cylinder-ram unit 28 is desirably interposed between the sliding frame 19 of the plate 17, hinged through 27 onto the plate-raising and lowering cursor 25, and said cursor 25, said unit 28 being designed to control the vertical tilting motion of said plate-supporting sliding frame 19.

According to the invention, when retracted, the separator plate 17 is entirely housed in the body of the stacker, i.e. does not project therefrom.

Moreover, according to the invention, the translation guides 26 designed to control the upward and downward motion of the separator plate 17 comprise two channel sections housing the sliding cursor 25 which in turn supports the aforementioned frame 19, said cursor 25 being driven by means of lateral chains 26a provided with gears at their respective ends and in turn driven by means of other chains running within said channel sections and powered by an independent, preferably D.C., reversing electric motor.

Preferably, the lateral chains 7b controlling the motion of the fork 8 are driven by an independent, desirably D.C., reversing electric motor.

According to the invention, the jogging 33, pressing 34 and flow-interrupting units are housed within rear side panels 5, fitted onto the sides 3 of the stacker, said rear panels 5 defining a housing for the electric control board of the stacker.

According to the invention, the path 32 defined by the signature-conveying belts in the rear side panels 5 is desirably horizontal.

Moreover, according to the invention, the rear portion of said projecting side panels 5 features a vertically tilting connection path 31, the inclination of which may be adjusted depending on the relative height of the rotary press outlet.

Advantageously, the motor 9 which controls the quick descent of the stack co-operates with a known electric component, through which the stroke of the fork 8 may be interrupted temporarily, in order to enable the operator to place the upper endboard onto the stack 16.

With the improved stacker developed in accordance with this invention, several different advantages are achieved, as noted hereinafter.

The operation of the stacker may be checked from a more comfortable central position, and the separator plate is always within reach even when in its upper limit stop position. This enables the operator to perform all the necessary operations, such as the adjustment and line-up of the top-end positioners, both more quickly and more accurately.

The separator plate is disposed inside the stacker in order to prevent accidental injury, hence the operator may perform all the relevant functions with a higher degree of safety. Both the height of the stacker and the length of the horizontal signature-conveying belts have been reduced considerably; as a result, the stacker according to the invention features limited overall dimensions. This, in turn, implies significant structural and functional advantages. For instance, the side panels of the stacker may be obtained directly from steel plates produced in standard sizes and, therefore, with a limited amount of off-cuts. The side panels provided to support the signature-conveying path may be designed as projecting members, to be mounted onto the framework of the stacker. This offers an additional advantage, in that a housing for the electric switchboard of the stacker is obtained in the space provided under said projecting side panels. This feature is of considerable importance because it offers the possibility of placing the switchboard in a suitable, readily accessible location without adding to the overall dimensions of the stacker. Moreover, as the switchboard is independent of the stacker, it is not subject to mechanical vibrations, which might otherwise damage the more delicate electronic components through which the stacker is controlled.

The total cost of the stacker is further reduced by eliminating the pneumatic cylinder-ram units. Indeed, the adoption of independent, reversing electric motors for the separator plate and the fork simplifies the various steps involved in the operating cycle and, as regards the fork-driving motor, ensures greater safety when lowering the stacks because braking is effected by the electric motor itself rather than by a pneumatic unit. Where the upper endboards are to be placed automatically onto the stacks, an electric motor is undoubtedly the most effective means to readily interrupt the quick downstroke of the fork and, therefore, bring it to a halt.

The signature conveyance path is made considerably shorter as the outlet through which the signatures are delivered and placed onto the separator plate is set at approximately the same height as the outlet of the traditional rotary presses. This offers an additional advantage, in that the conveyance path is at all times level, whereas conventional vertical stackers include a steeply-sloping section which, as noted earlier, affects the signatures undesirably.

The stackers designed in accordance with this invention are easy to construct, and the type of equipment used to control the motion of translation of the separator plate is traditional and extremely dependable.

BRIEF DESCRIPTION OF THE DRAWINGS

Further features, advantages and details of the vertical signature stacker according to the invention will become readily apparent from the following description of a preferred, though by no means exclusive, embodiment thereof, to be considered in conjunction with the enclosed schematic drawings wherein.

DESCRIPTION OF THE PREFERRED EMBODIMENT

Figure 1:
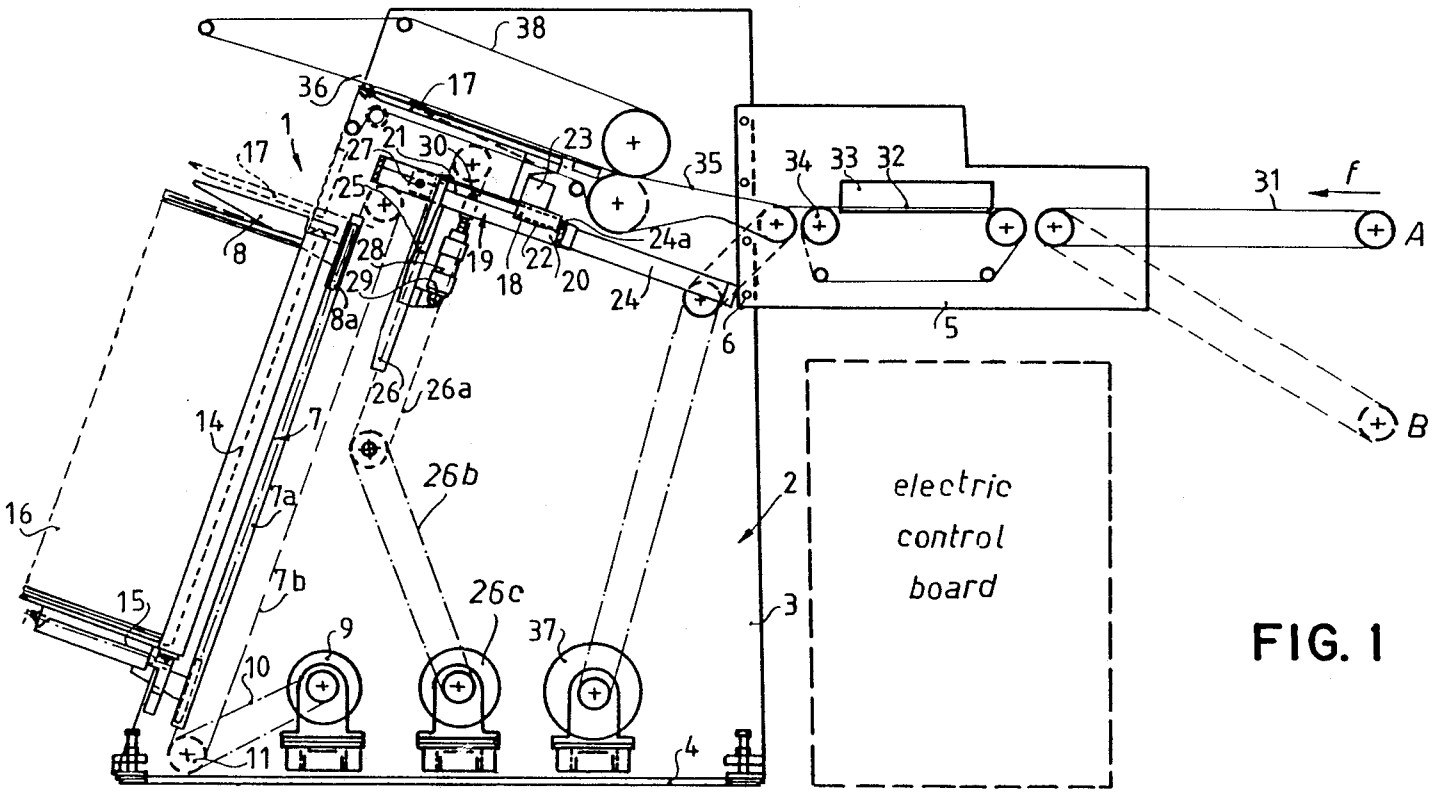
FIG. 1 is a longitudinal sectional view across the center of a vertical stacker according to the invention.
Figure 2:
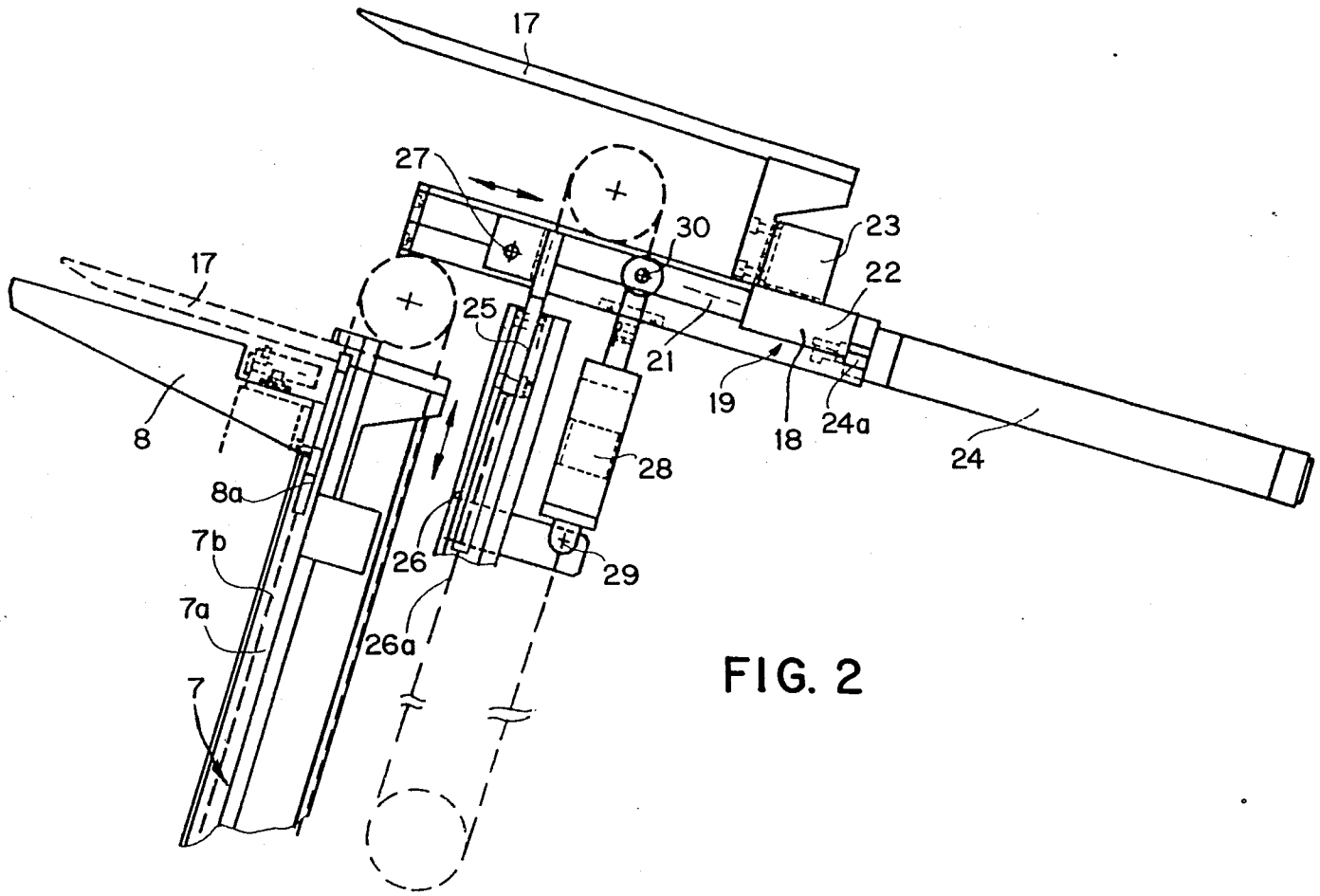
FIG. 2 is a detail of the plate-supporting and controlling units as reproduced on a larger scale.

With reference to the above Figures, reproduced to different scales, wherein each component is marked by a specific reference number, the improved stacker according to the invention is indicated, in its entirety, at 1. Said stacker 1 comprises a framework 2 featuring two side panels 3, which are joined to each other by a bedplate 4 and by a number of crosspieces (not illustrated herein). The framework 2 further comprises rear side panels 5, which are mounted as projecting members onto side panels 3, e.g. by means of screws 6. Said rear side panels 5 are designed to support the signature-conveying path (not shown), in correspondence with the relevant signature-handling components, as described more specifically hereinafter. The translation guides of fork 8 are marked 7. Said guides may be constructed in accordance with a conventional design, e.g. comprising channel sections **7*a* housing lateral chains 7*b* supporting a cursor 8*a*, fork 8 resting on said cursor 8*a*. The upward and downward motion of fork 8 is effected by means of an independent reversing electric motor 9, desirably a D.C. motor, which, through gearing 10, drives the bottom geared wheels 11 of said lateral traversing chains 7*b*. The sliding wall through which the stacks 16 are lowered and the bottom wall supporting said stacks are marked 14 and 15 respectively, both walls being made up of a set of adjacent rollers. In this particular illustration, roller board 14** is positioned in such a way as to form a 20° angle with the vertical.

The separator plate, which is only sketched out in the drawings, is indicated at 17. The plate is supported within the framework 2 of the stacker and is secured to the cursor 18 of the plate sliding frame marked 19. Said frame may comprise, for instance, an actual frame-like structure 20 and two slide bars 21. Said cursor 18 is made up of two sliding sleeves 22, running on bars 21 and connected to each other by a crosspiece 23 which in turn carries the separator plate 17, said plate being interchangeable in the preferred embodiment. Cursor 18 is connected to the free end of the piston rod **24*a* (no detailed view thereof being provided in the drawings) of the cylinder-ram unit 24 controlling the forward and reverse motion of separator plate 17 and fixed to said sliding frame 19. The stroke of the piston rod 24*a* is desirably adjustable as a function of the signatures that are to be treated. The sliding frame 19 is connected to cursor 25 running on guides 26 fitted inside said framework 2 and specially designed to control the upstrokes and downstrokes of the separator plate 17. Said guides 26 may be channel-shaped, like the guides 7*a* referred to earlier herein, and be designed in such a way as to house the chains 26*a* supporting cursor 25 and driven, through an intervening chain 26*b*, by a reversing, preferably D.C., electric motor 26*c*. Similarly, cursor 25 may feature outer guide sleeves running on corresponding guide bars (not shown herein). In this particular illustration, the connection between said cursor 25 and said slide frame 19 is effected by means of two coaxial hinge pins 27. The relevant drawing also features a cylinder-ram unit 28 interposed between cursor 25 and slide frame 19, said unit 28 being hinged onto cursor 25 through 29 and onto slide frame 19 through 30. The slide frame 19, hence the separator plate 17, are desirably hinged onto said cursor 25, in order to enable said plate 17 to tilt upwards during its forward motion and to tilt downwards when disposed, at some distance, above the stack placed on the descending fork. The translation of the plate between its two limit stop positions, which are parallel to one another, thus occurs through a compound motion, said translation being linear or, desirably, curvilinear, depending on the size of the signatures or on the constructive parameters selected in each specific case. Said compound motion is designed to avoid any possible impact of the tip of the separator plate against the upper part of the stack which has previously been placed onto the fork 8. Said motion may be achieved by combining the motions of the two cylinder-ram units 24 and 28, or, alternatively, through the interposition of a positioning cam co-operating with separator plate 17. The profile and exact location of said cam are to be determined in accordance with one's specific requirements. The desired motion of translation of the separator plate may also be achieved through a driving cam alone, namely without employing the cylinder-ram unit 28**; in this case, however, it would be more difficult to attain the required degree of accuracy in the repetition of the compound movements. The drawings readily show that when the separator plate is in its upper limit stop position, i.e. the position wherein it is ready to perform the interruption of the flow of signatures, the plate itself is housed entirely within the body of the stacker; the dotted lines refer to the plate in its tilted-up position, namely the position wherein the plate is ready to start a new stack.

The signature conveyance path is roughly horizontal and, in this particular instance, made up of a number of conveyor belts 31; the path itself can be tilted up or down, position A corresponding to the outlet of the higher rotary presses, and position B being roughly level with the outlet of the lower rotary presses. The section of the signature-conveying path located inside the stacker is marked 32, said section featuring a jogging unit 33, a pressing unit 34 as well as a third unit (only sketched out in the drawing) specially designed to interrupt the flow of signatures and thereby enable the separator plate 17 to perform its function effectively. Section 32 of the conveyance path is followed by section 35, which leads to the signature delivery outlet 36. Section 35 is slightly slanted because it must be at right angles with roller board 14. The drawing clearly shows that the signature path is essentially horizontal and does not feature the steeply-sloping section which is typically found in conventional vertical stackers equipped with an outwardly-projecting separator plate. The signature-conveying path is driven by a separate motor 37, of a known type. The unit defining the upper signature-conveying path is marked 38.

In the stacker according to the invention, the various steps involved in the operating cycle—preliminary stacking, translation of the preliminary stack from the separator plate to the fork, completion of the stack and quick descent of the stack onto the supporting roller board—are performed in the same way as they normally are in conventional vertical stackers featuring an outwardly-projecting separator plate.

From the above description it is readily apparent that with the stacker according to the invention the objects and advantages referred to hereintofore are effectively achieved. In particular, the operator is able to perform the required supervisory functions in a simpler, more effective way, as all parts of the stacker are readily accessible and its construction is less bulky as compared with that of conventional stackers. This also means that the assembled stackers can be transported more easily: the design features an essentially horizontal signature conveyance path while offering simple, highly reliable means to interrupt the quick descent of the stack-carrying fork so that the upper endboards may be placed automatically onto the finished stacks during the downward translation thereof.

Moreover, construction costs are reduced considerably, and the operations required in order to stretch the conveyor belts are simplified. As a result of lesser wear, belt rupture is less likely to occur. Similarly, stacker operation is more reliable. In addition, a housing for the relevant electric switchboard is conveniently defined in the area located below the rear panels of the stacker. Practically all the components may be replaced with other technically and/or functionally equivalent ones, without exceeding the scope of this invention.

For instance, the design of the slide frame, of the relevant vertical guides, or of the separator plate-supporting member may be changed or modified without exceeding the boundaries defining the scope of the invention.

All of the features contained in the description, claims and drawings are to be considered substantial to this invention, both singly and in any combination thereof.

I claim:

1. Apparatus for forming stacks of signatures comprising:

(a) a stacker framework;

(b) a belt driven conveyor for delivering signatures provided by a rotary press to a location interiorly of the framework;

(c) a separator plate disposed adjacent the conveyor for interrupting the flow of signatures on the conveyor and forming the initial part of each stack;

(d) a slide frame disposed within the stacker framework and supporting the separator plate, the slide frame having a first drive unit and translation means associated therewith for raising and lowering the slide frame and separator plate and having an upper limit stop position wherein the separator plate is generally level with the head of an operator, the first drive unit and translation means comprising two channel sections housing a slidable cursor, the slidable cursor supporting the slide frame and being coupled to and driven by lateral chains that engage a gear coupled to a D.C. reversing electric motor, the slide frame having a second drive unit and translation means associated therewith the retracting and advancing the separator plate, and a third drive unit and translation means for tilting the slide frame and separator plate;

(e) a fork onto which signatures carried by the separator plate are placed, the fork having a fourth drive unit and translation means associated therewith for raising and lowering the fork, at least the first and fourth drive units being independently operable of each other; and (f) a sliding wall disposed adjacent an exit end of the stacker framework for lowering the stacks, and a stack supporting wall disposed adjacent the sliding wall, each wall comprising a plurality of rollers.

2. Apparatus according to claim 1 wherein the slide frame comprises two slide bars and the second drive unit and translation means comprises a cursor having two sleeves engaging the slide bars, the sleeves being connected to each other by a cross piece, the cross piece carrying the separator plate, the cursor being connected to the piston rod of a cylinder-ram unit for retracting and advancing the cursor.

3. Apparatus according to claim 1 wherein the third drive unit comprises a cylinder ram unit having a first end coupled to the slide frame and a second end coupled to means associated with the first drive unit and translation means for controlling the amount of tilt of the slide frame and separator.

4. Apparatus according to claim 1 wherein the separator plate, when fully retracted, is entirely housed within the stacker framework.

5. Apparatus according to claim 1 wherein the fourth drive unit comprises lateral chains coupled to the fork and to a D.C. reversing electric motor.

6. Apparatus according to claim 1 further comprising jogging, pressing and flow-interrupting units housed within projecting rear side panels of the stacker framework, the rear side panels defining a housing for an electric control board.

7. Apparatus according to claim 6 wherein at least a portion of the belt driven conveyor is disposed within the rear side panels and is generally horizontally disposed.

8. Apparatus according to claim 6 wherein at least a portion of the conveyor belt is hingedly coupled to the rear side panels for adjusting the slant thereof according to the relative height of an outlet of the rotary press.

9. Apparatus according to claim 1 further comprising means for temporarily interrupting the down stroke of the fork to provide time for placing an upper endboard onto the apparatus.

10. Apparatus according to claim 1 wherein there is a signature conveying path within the stacker framework and the signature conveying path is substantially horizontal.

* * * * *